US005897824A

United States Patent [19]

Marschke

[11] Patent Number: 5,897,824

[45] Date of Patent: Apr. 27, 1999

[54] SURFACE HEATING FOR A CORRUGATED MEDIUM WEB

[75] Inventor: Carl R. Marschke, Phillips, Wis.

[73] Assignee: Marquip, Inc., Phillips, Wis.

[21] Appl. No.: 08/782,963

[22] Filed: Jan. 13, 1997

[51] Int. Cl.[6] ..... B31F 1/20

[52] U.S. Cl. ..... 264/286; 156/205; 156/462; 425/336

[58] Field of Search ..... 156/205, 210, 156/462; 264/286; 425/336; 34/624; 432/59, 230; 162/117

[56] References Cited

U.S. PATENT DOCUMENTS

| | | | |
|---|---|---|---|
| 235,698 | 12/1880 | Newton | 264/286 |
| 2,487,647 | 11/1949 | Goettsch | 156/472 |
| 2,952,297 | 9/1960 | Hollis | 264/286 |
| 3,349,222 | 10/1967 | Johnston | 34/624 |
| 3,630,806 | 12/1971 | Kitajima et al. . | |
| 3,994,768 | 11/1976 | Roberts . | |
| 4,038,130 | 7/1977 | Cosby et al. . | |
| 4,461,665 | 7/1984 | Schertler . | |
| 5,156,714 | 10/1992 | Thomas . | |

*Primary Examiner*—Richard Crispino
*Attorney, Agent, or Firm*—Andrus, Sceales, Starke & Sawall

[57] ABSTRACT

In a single facer, the premoistened medium web is dried on both surfaces to a shallow depth immediately prior to passage through the corrugating nip. The dried shallow surface layers substantially decrease friction between the flutes of the corrugating rolls and the paper while the interior of the web is maintained in a moist condition necessary for formability.

6 Claims, 1 Drawing Sheet

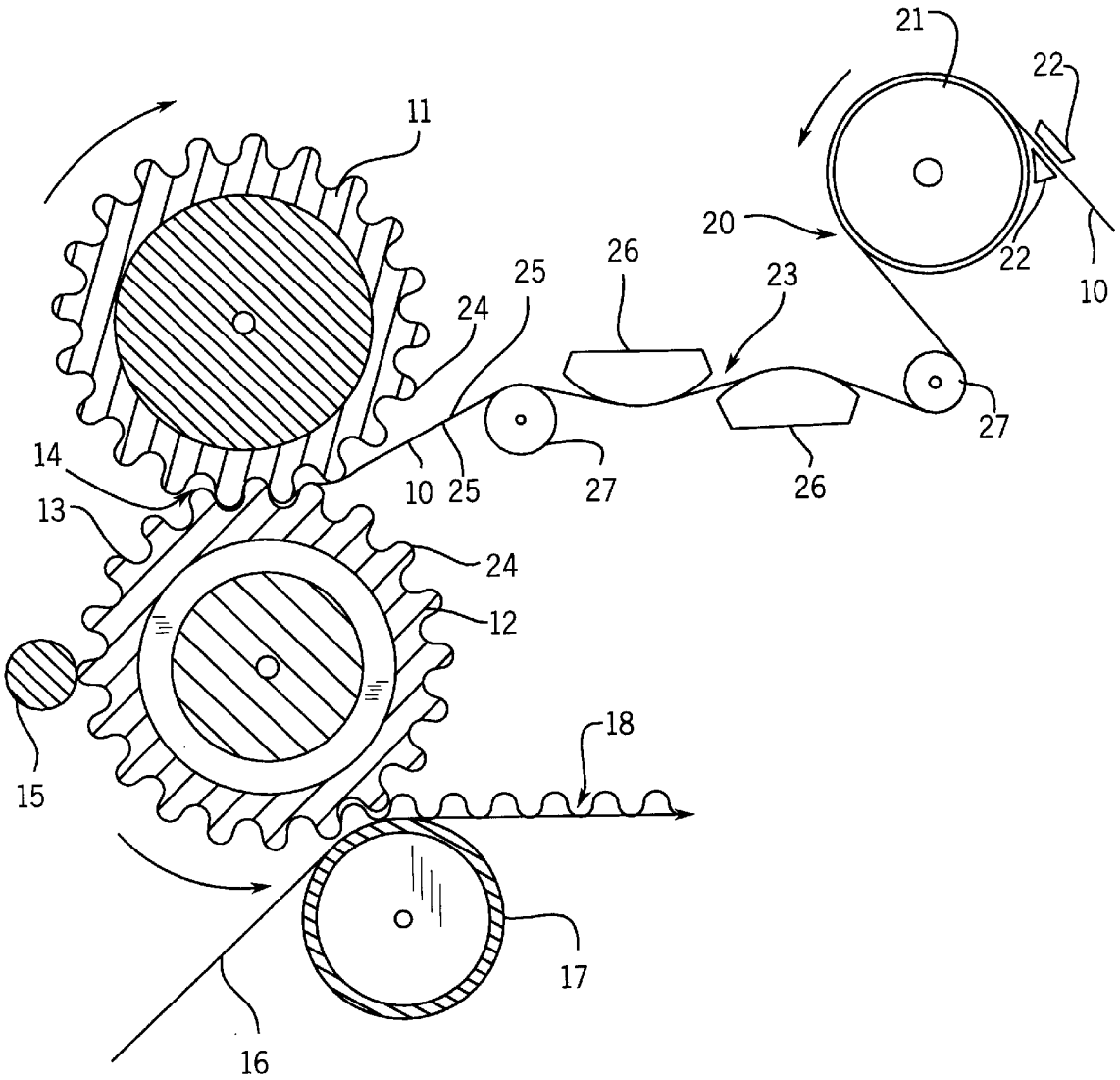
21
22
11
20
22
10
26
25
23
24
27
14
10
25
27
26
13
24
12
18
15
17
16

SURFACE HEATING FOR A CORRUGATED MEDIUM WEB

BACKGROUND OF THE INVENTION

The present invention pertains to the treatment of a paper web which is subsequently corrugated to form the fluted medium in the manufacture of corrugated paperboard. More particularly, the present invention pertains to an apparatus and method for drying a shallow surface layer of the premoistened web immediately prior to entry into the corrugating nip.

In the manufacture of corrugated paperboard, the corrugated medium is formed by passing the paper web through the nip formed by a pair of counterrotating fluted corrugating rolls. Upstream of the corrugating nip, the medium web is heated and premoistened to enhance the formability of the flutes by the corrugating rolls. In a typical preheater, the web is heated by passing it around a heated roll with moisture applied either by a water spray or the application of steam. The premoistened web is transferred directly into the corrugating nip and the fully moistened web permits the flutes to be formed therein without rupturing the web. However, the moisture in the web surface layers significantly increases the coefficient of friction of the web surface. This in turn directly affects the corrugating process because increased friction between the paper and the flutes of the corrugating rolls results in a significant tension increase in the medium web as it moves through the labyrinth of the fluting process.

SUMMARY OF THE INVENTION

In accordance with the method and apparatus of the present invention, both sides of the web are heated immediately prior to entry into the corrugating nip to dry shallow surface layers of the web while leaving the major center portion of the paper moist. This allows the paper to retain sufficient flexibility to deform without rupture while decreasing the surface friction between the paper and the corrugating rolls during forming.

In accordance with the method of the present invention, a method for corrugating a premoistened paper web includes the steps of drying the opposite surface layers of the paper web with a drying device positioned directly upstream of the corrugating nip while maintaining the interior of the web in its premoistened condition, and feeding the web into the corrugating nip immediately after surface drying. In the preferred embodiment, the drying step comprises feeding the web over a drying device having stationary heated contact faces in direct engagement with both web faces. The surface layers are preferably dried to a depth of about 0.0005 inch (about 12 microns).

The apparatus of the present invention for drying shallow surface layers on opposite sides of a moist running paper web being fed into the nip of a corrugator comprises a pair of heating devices disposed on opposite sides of the web upstream of the nip, and means for directing the web between the heating devices to cause a heat transfer to the web sufficient to dry the opposite surface layers without significantly changing the moisture content of the interior of the web. In the preferred embodiment, the heating devices include curved heating surfaces, and the web directing means is operative to hold the web in contact with the heating surfaces for direct heat transfer. The heating devices are preferably steam heated.

BRIEF DESCRIPTION OF THE DRAWING

The single drawing FIGURE is a generally schematic side elevation view of a single facer utilizing a web surface heating device of the present invention.

DETAILED DESCRIPTION OF THE PREFERRED EMBODIMENT

In a single facer for the production of a single face corrugated web, a paper medium web 10 is fed into the nip 14 formed by an upper corrugating roll 11 and a lower corrugating roll 12, the outer surfaces of which are provided with interengaging flutes 24 which deform the medium web 10 to form a corrugated medium 13, all in a manner well known in the art. The corrugated medium 13 remains on the lower corrugating roll 12 after passage through the corrugating nip 14 and a glue roll 15 is positioned to apply a starch-based adhesive to the exposed flute tips of the corrugated web 13. A liner web 16 is brought into contact with the glued flute tips of the corrugated medium 13, as with a contacting pressure roll 17 to form a single face web 18. Devices other than a pressure roll 17 may be utilized to bring the component webs 13 and 16 together and to form the initial glue bond therebetween.

In order to enhance the formability of the medium web 10 in the nip 14 between the corrugating rolls 11 and 12, it is known in the prior art to preheat and moisten the web. A typical web conditioner 20 includes a preheating roll 21 around which the medium web 10 is wrapped and a moisture applying device 22 which moistens the web either by the application of water spray or steam. The preheating roll 21 may be heated in any convenient manner, typically also with steam.

The system thus far described comprises a conventional single facer and, prior to the subject invention, the heated and premoistened medium web 10 was fed directly into the corrugating nip 14. In accordance with the present invention, the premoistened and preheated medium web 10 is directed through a surface heating device 23 immediately before entry into the corrugating nip to dry the surface layers on both sides of the web to a very shallow depth. The shallow dry layers on both web surfaces 25 reduce considerably the coefficient of friction and thus the frictional forces developed between the web surfaces and the surfaces of the flutes 24 on the corrugating rolls 11 and 12. It is known that tension build-up of the medium web during flute formation increases exponentially with the coefficient of friction, so that small changes in that factor result in large changes in tension. This allows the corrugations to be formed more easily and with less stress on the web. At the same time, the moist interior of the web 10 is maintained and the formability of the corrugated medium 13 is not adversely affected. It is believed that surface moisture from the medium web 10 need be removed only to a depth of about 0.0005 inch (about 12 microns).

In the preferred embodiment, the surface heating device 23 comprises a pair of steam heated heating plates 26. The heating plates have curved outer surfaces over which the medium web 10 is reverse wrapped with the use of upstream and downstream positioning rollers 27.

The heating plates 26 are preferably heated to a high temperature in the range of about 350–380° F. (177–193° C.). It is only necessary to maintain heating contact of the medium web 10 with the surfaces of the heating plates 26 for a short time. With incoming medium web speeds up to about 1,000 fpm (about 5 mps), surface contact of the web with the heating plates in the direction of web travel of only about 6"(15 cm) is required to dry both web surfaces 25 to a depth of about 0.0005 inch (about 12 microns). Those in the art will understand that the length of contact and wrap angle can be varied to suit particular applications.

Although heating by direct surface contact as described above is preferred, non-contact heating as by the use of infrared or radiant heaters, or hot air blowers, may also be utilized. Further, although steam is preferred for use in heating the plates 26, any other suitable heating means may be utilized, including electric and radiant heaters.

I claim:

1. A method for corrugating a paper web in a nip formed by two counterrotating engaging fluted rolls, said method comprising the steps of:

(1) moistening and preheating a paper web; and then (2) drying opposite surface layers of the paper web with a drying device positioned directly upstream of the nip while maintaining the interior of the web moistened; and (3) feeding the web into the nip of the fluted rolls immediately after drying the surface layers to corrugate the paper web.

2. The method as set forth in claim 1 wherein said drying step further comprises feeding said web over a drying device having a stationary heated contact face in direct contact with each of the surface layers.

3. The method as set forth in claim 1 wherein said surface layers are dried to a depth of about 0.0005 inch (about 12 microns).

4. In a corrugating apparatus having counterrotating engaging fluted rolls forming a nip downstream of a paper web moistening and preheating device, the improvement comprising:

a pair of heating devices disposed on opposite sides of the web downstream of the paper web moistening and preheating device and immediately upstream of the nip;

means for directing the web between said heating devices to cause a transfer of heat to the web sufficient to dry opposite surface layers of the paper web without significantly changing the moisture content of the interior of the web.

5. The apparatus as set forth in claim 4 wherein said heating devices include curved heating surfaces, and said web directing means is operative to hold the web in contact with the heating surfaces for direct heat transfer.

6. The apparatus as set forth in claim 5 wherein said heating devices are steam heated.

* * * * *